US008470504B2

(12) United States Patent
Sekiya et al.

(10) Patent No.: US 8,470,504 B2
(45) Date of Patent: Jun. 25, 2013

(54) ELECTROPHOTOGRAPHIC PHOTOSENSITIVE MEMBER, PROCESS CARTRIDGE, AND ELECTROPHOTOGRAPHIC APPARATUS

(75) Inventors: Michiyo Sekiya, Mishima (JP); Hideaki Nagasaka, Suntou-gun (JP); Kunihiko Sekido, Numazu (JP); Shinji Takagi, Yokohama (JP); Akihiro Maruyama, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 259 days.

(21) Appl. No.: 12/911,804

(22) Filed: Oct. 26, 2010

(65) Prior Publication Data

US 2011/0104598 A1 May 5, 2011

(30) Foreign Application Priority Data

Nov. 2, 2009 (JP) ..... 2009-252121

(51) Int. Cl.
*G03G 15/00* (2006.01)

(52) U.S. Cl.
USPC ..... 430/56; 430/57.1; 430/60; 399/111; 399/159

(58) Field of Classification Search
USPC ..... 430/56, 57.1, 60; 399/111, 159
See application file for complete search history.

(56) References Cited

U.S. PATENT DOCUMENTS 5,154,996 A * 10/1992 Makino et al. ..... 430/59.6
5,763,127 A 6/1998 Goshima et al.
6,750,288 B2 6/2004 Pradel
6,831,131 B2 12/2004 Bouilloux et al.
2003/0040579 A1 2/2003 Pradel
2003/0118927 A1* 6/2003 Nakamura et al. ..... 430/65
2003/0130429 A1 7/2003 Bouilloux et al.
2004/0202806 A1 10/2004 Pradel
2007/0059619 A1 3/2007 Shimoyama et al.
2011/0104601 A1* 5/2011 Takagi et al. ..... 430/57.1

FOREIGN PATENT DOCUMENTS

CN 101131548 A 2/2008
JP 56-052757 5/1981
JP 02-181158 7/1990

(Continued)

OTHER PUBLICATIONS

Communication dated Feb. 25, 2011, forwarding a European Search Report dated Feb. 18, 2011, in counterpart European Application No. 10014138.1-1217.

(Continued)

*Primary Examiner* — Mark F Huff
*Assistant Examiner* — Rachel Zhang
(74) *Attorney, Agent, or Firm* — Fitzpatrick, Cella, Harper & Scinto

(57) ABSTRACT

The electrophotographic photosensitive member contains a support; and a first intermediate layer, a second intermediate layer and a photosensitive layer which are provided on the support in this order, in which the second intermediate layer contains a polyolefin resin and a metal oxide particle having a volume-average particle diameter of 20 nm or less, and the first intermediate layer contains a metal oxide particle, and the volume-average particle diameter of the metal oxide particle contained in the first intermediate layer is 10 times or more to 200 times or less as large as the volume average particle diameter of the metal oxide particle contained in the second intermediate layer.

10 Claims, 2 Drawing Sheets

FOREIGN PATENT DOCUMENTS

| | | | |
|---|---|---|---|
| JP | 2002-040698 | | 2/2002 |
| JP | 2002-040698 | A | 2/2002 |
| JP | 2003-105145 | A | 4/2003 |
| JP | 2003-147028 | A | 5/2003 |
| WO | WO 2006104225 | * | 10/2006 |

OTHER PUBLICATIONS

English translation of Office Action dated Jan. 30, 2012 in Chinese Appln. No. 201010530268.8.

* cited by examiner

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

1. Field of the Invention

The present invention relates to an electrophotographic photosensitive member, and a process cartridge and an electrophotographic apparatus each provided with the electrophotographic photosensitive member.

2. Description of the Related Art

The electrophotographic photosensitive member basically has a support and a photosensitive layer formed on the support. The photosensitive layer is generally formed of a charge generation layer containing a charge-generating material and a hole transport layer containing a hole transporting material, in this order from the support side. Further, in many cases, a layer called an intermediate layer (which may also be called an undercoat layer) is provided between the photosensitive layer and the support. The intermediate layer is required to have an electric blocking function of preventing a hole injection from the support when a voltage is applied to the electrophotographic photosensitive member. The reason for this is as follows. When the hole injection from the support into the photosensitive layer occurs, it causes decrease of the chargeability and image contrast, and especially, when a reversal development system is employed, it causes black dots in a white portion, which degrades image quality.

On the other hand, the intermediate layer is required to have an electric resistance in an appropriate range. This is because when the electric resistance of the intermediate layer is too high, the charge generated in the photosensitive layer is liable to be retained in the photosensitive layer, which easily causes an increase in residual potential, a fluctuation in potential due to the repeated use, and a ghost phenomenon.

Japanese Patent Application Laid-Open Nos. 56-52757 and 02-181158 disclose as the intermediate layer having an electric resistance in an appropriate range and an electric blocking function, an intermediate layers containing a resin and metal oxide particles.

Further, Japanese Patent Application Laid-Open No. 2002-40698 discloses a technology of providing a plurality of intermediate layers containing inorganic compounds having different particle diameters (an inorganic compound particles having a small particle diameter is contained in the intermediate layer on the photosensitive layer side, and an inorganic compound particles having a large particle diameter is contained in the intermediate layer on the support side).

In recent years, the demand for enhancing the image quality of an electrophotographic apparatus is increasing more and more. In particular, the demand for the image quality of a half-tone image and a solid image is increasing in accordance with the coloring (full coloring) of an output image. On the other hand, in the case of performing an image forming wherein only a portion (light-irradiated portion) of one output image is irradiated with light will become half-tone in the next rotation, an allowable range for a phenomenon in which the density of only the portion irradiated with light will become high (positive ghost phenomenon), or, conversely, for a phenomenon in which the density will become low (negative ghost phenomenon), is becoming narrow. Therefore, even if steps are taken to deal with such situation by providing the intermediate layer containing metal oxide particles, or a plurality of intermediate layers containing inorganic compound particles having different particle diameters, the ghost phenomenon may exceed an allowable level although the increase in residual potential and the fluctuation in potential caused by the repeated use can be suppressed.

Thus, under the circumstances in which the demand for enhancing the image quality of the electrophotographic apparatus becomes high, the related arts are not sufficient for the effect of suppressing the generation of the ghost phenomenon (ghost suppression effect), while keeping the electric blocking function.

SUMMARY OF THE INVENTION

The present invention provides an electrophotographic photosensitive member that is excellent in the effect of suppressing black dots and the effect of suppressing a ghost. The present invention also provides a process cartridge and an electrophotographic apparatus each including the electrophotographic photosensitive member.

The inventors of the present invention have paid attention to an intermediate layer of an electrophotographic photosensitive member, and have found that an intermediate layer containing a polyolefin resin and a metal oxide particle, and having the controlled volume-average particle diameter of the metal oxide particle, can solve the above-mentioned problems.

The present invention is an electrophotographic photosensitive member including a support, and a first intermediate layer, a second intermediate layer and a photosensitive layer, the layers being provided on the support in this order, in which the second intermediate layer contains a polyolefin resin and a metal oxide particle having a volume-average particle diameter of 20 nm or less, the first intermediate layer contains a metal oxide particle, and the volume-average particle diameter of the metal oxide particle contained in the first intermediate layer is 10 times to 200 times as large as the volume average particle diameter of the metal oxide particle contained in the second intermediate layer.

According to the present invention, it is possible to provide an electrophotographic photosensitive member that is excellent in the effect of suppressing black dots and the effect of suppressing a ghost. Further, it is also possible to provide a process cartridge and an electrophotographic apparatus each including the electrophotographic photosensitive member Further features of the present invention will become apparent from the following description of exemplary embodiments with reference to the attached drawings.

DESCRIPTION OF THE EMBODIMENTS

Figure 1:
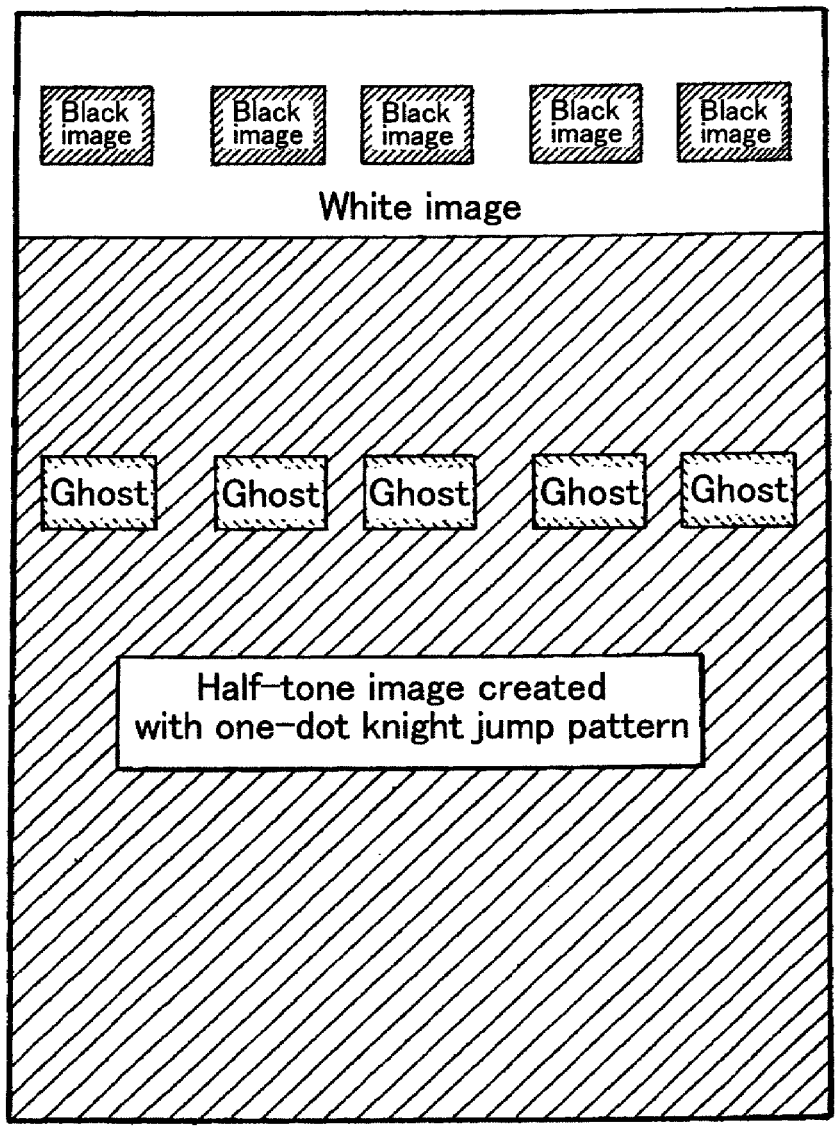
FIG. 1 is a view illustrating an image for evaluating a ghost phenomenon used in Examples.

In order to suppress the ghost phenomenon, it is necessary to reduce residual charge which is one of the causes for the ghost phenomenon. Specifically, the residual charge means electrons formed when the charge generated at a time of exposure (image exposure) cannot move completely to the support by the time of subsequent charging. In order to reduce a residual amount, it is necessary to sufficiently keep the movement of charge from the photosensitive layer (charge generation layer) to the intermediate layer, in particular, the movement of charge in a low electric field.

On the other hand, in order to have the intermediate layer performs the blocking function against the hole injection, it is necessary to block the injection of charge from the support to the intermediate layer, in particular, the injection of charge in a high electric field.

In the case of using an intermediate layer in which a metal oxide particle is dispersed in a resin, blocking function to hole injection is satisfactory, when the particle diameter (volume-average particle diameter) of the metal oxide particle is large, but an effect of suppressing a ghost is insufficient. In contrast, when the particle diameter of the metal oxide particle is small, the effect of suppressing a ghost is improved, but there is a tendency that the blocking function to hole injection is insufficient.

The inventors of the present invention have made intensive studies and have found that the above-mentioned problem can be solved by an electrophotographic photosensitive member including a support, and a first intermediate layer, a second intermediate layer, and a photosensitive layer, the layers being provided on the support in this order, in which the second intermediate layer contains a polyolefin resin and a metal oxide particle having a volume-average particle diameter of 20 nm or less, the first intermediate layer contains a metal oxide particle, and the volume-average particle diameter of the metal oxide particle contained in the first intermediate layer is 10 times to 200 times as large as the volume-average particle diameter of the metal oxide particle contained in the second intermediate layer, and have achieved the present invention.

The reason why the formation of a ghost phenomenon can be suppressed while the blocking function to hole injection is held according to the present invention is considered as follows.

Among the intermediate layers, when the volume-average particle diameter of a metal oxide particle contained in the second intermediate layer on a side of a photosensitive layer containing a charge-generating material is set to be 20 nm or less, electrons move efficiently from the charge-generating material to the metal oxide particle in a low electric field after light exposure. Further, the use of a polyolefin resin with a small dielectric constant reduces trap sites in the intermediate layer and enhances the movement of electrons in a low electric field in the second intermediate layer remarkably, and thus, sufficient effects of suppressing a ghost can be obtained.

Meanwhile, the blocking function to hole injection can be suppressed by providing the first intermediate layer between the second intermediate layer and the support. As described above, the second intermediate layer contains a polyolefin resin having a small dielectric constant and a high resistance, and hence, one has only to take the hole injection into the metal oxide particle into account. In order to suppress the hole injection, the first intermediate layer is allowed to contain a metal oxide particle having a volume-average particle diameter of 10 times to 200 times as compared with that of the metal oxide particle contained in the polyolefin resin. When the first intermediate layer is allowed to contain such metal oxide particle, contact points between the charge and the metal oxide particle are appropriate, and the hole injection is unlikely to occur even in a high electric field, while the conductivity of the first intermediate layer is maintained in some measure.

First, the second intermediate layer of the present invention is described.

The second intermediate layer of the present invention is a layer on the photosensitive layer side among the intermediate layers, and contains a polyolefin resin and a metal oxide particle having a volume-average particle diameter of 20 nm or less.

The polyolefin resin used in the present invention refers to a polymer obtained by polymerizing an olefin. Further, the olefin refers to a hydrocarbon compound having at least one C=C (double-bond between carbons). The polyolefin resin in the present invention may be a polymer obtained by polymerizing only an olefin or a polymer obtained by copolymerizing an olefin with any other monomer.

It is preferred that the polyolefin resin used in the present invention contains (A1), (A2) and (A3) as described below, and the mass ratio of the (A1), (A2) and (A3) satisfies a formula as described below.

$$0.01 \leqq (A2)/\{(A1)+(A2)+(A3)\}\times 100 \leqq 30$$

$$55/45 \leqq (A1)/(A3) \leqq 99/1$$

It is more preferred that the mass ratio of the (A1), (A2) and (A3) satisfies a formula as described below.

$$0.01 \leqq (A2)/\{(A1)+(A2)+(A3)\}\times 100 \leqq 10$$

It is still more preferred that the mass ratio of the (A1), (A2) and (A3) satisfies a formula as described below.

$$0.01 \leqq (A2)/\{(A1)+(A2)+(A3)\}\times 100 \leqq 5$$

(A1): a repeating structural unit represented by the following formula (11):

(11)

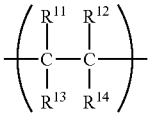

where $R^{11}$ to $R^{14}$ each independently represent a hydrogen atom or an alkyl group;

(A2): a repeating structural unit represented by one of the following formulae (21) and (22):

(21)

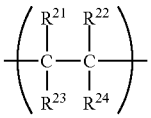

(22)

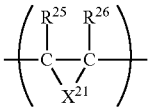

where $R^{21}$ to $R^{24}$ each independently represent a hydrogen atom, an alkyl group, a phenyl group, or a monovalent group represented by $—Y^{21}COOH$ where $Y^{21}$ represents a single bond, an alkylene group or an arylene group; $R^{25}$ and $R^{26}$ each independently represent a hydrogen atom, an alkyl group or a phenyl group; and $X^{21}$ represents a divalent group represented by $—Y^{22}COOCOY^{23}—$ where $Y^{22}$ and $Y^{23}$ each independently represent a single bond, an alkylene group or an arylene group, provided that at least one of $R^{21}$ to $R^{24}$ represents a monovalent group represented by $—Y^{21}COOH$; and (A3): a repeating structural unit represented by one of the following formulae (31), (32), (33) and (34):

(31)

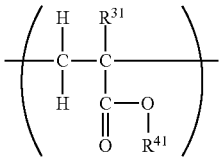

(32)

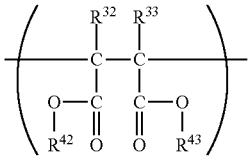

(33)

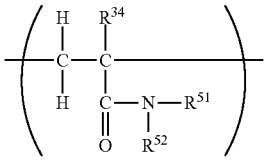

(34)

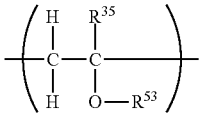

where $R^{31}$ to $R^{35}$ each independently represent a hydrogen atom or a methyl group; $R^{41}$ to $R^{43}$ each independently represent an alkyl group having 1 to 10 carbon atoms; and $R^{51}$ to $R^{53}$ each independently represent a hydrogen atom or an alkyl group having 1 to 10 carbon atoms.

Examples of the alkyl group represented by each of $R^{11}$ to $R^{14}$ in the formula (11) include a methyl group, an ethyl group, a propyl group and a butyl group. Preferably, $R^{11}$ to $R^{14}$ in the formula (11) each independently represents a hydrogen atom or an alkyl group having 1 to 6 carbon atoms, more preferably each independently represent a hydrogen atom or a methyl group, or particularly preferably all represent a hydrogen atom.

Those repeating structural units may be introduced through a polymerization reaction in the presence of a monomer having a carbon-carbon double bond. Examples of the monomer include ethylene, propylene, 1-butene, isobutene, 1-pentene, 4-methyl-1-pentene, 3-methyl-1-pentene and 1-hexene. Of those, ethylene is preferably used.

Examples of the alkyl group represented by each of $R^{21}$ to $R^{24}$ in the formula (21) include a methyl group, an ethyl group, a propyl group and a butyl group. As for $R^{21}$ to $R^{24}$ in the formula (21), it is preferred that three of $R^{21}$ to $R^{24}$ each represent a hydrogen atom and the other represents —COOH, or it is preferred that two of $R^{21}$ to $R^{24}$ each represent a hydrogen atom, one represents a methyl group, and the other represents —COOH.

Examples of the alkyl group represented by each of $R^{25}$ and $R^{26}$ in the formula (22) include a methyl group, an ethyl group, a propyl group and a butyl group. A repeating structural unit in which $R^{25}$ and $R^{26}$ each represent a hydrogen atom and $X^{21}$ represents —COOCO— in the formula (22) is preferred.

Those repeating structural units, i.e., unsaturated carboxylic acids and/or anhydrides thereof may be introduced through a polymerization reaction in the presence of a monomer having at least one carboxyl group or acid anhydride group or both the groups in the molecule (in a monomer unit). Examples of the monomer include acrylic acid, methacrylic acid, maleic acid, maleic anhydride, itaconic acid, itaconic anhydride, fumaric acid, crotonic acid, and half esters and half amides of unsaturated dicarboxylic acids.

Examples of the alkyl group having 1 to 10 carbon atoms represented by $R^{41}$ in the formula (31) include a methyl group, an ethyl group, a propyl group and a butyl group. Of those, a methyl group and an ethyl group are preferred. Those repeating structural units may be introduced through a polymerization reaction in the presence of a (meth)acrylate monomer. Examples of the monomer include methyl(meth)acrylate, ethyl(meth)acrylate and butyl(meth)acrylate.

Examples of the alkyl group having 1 to 10 carbon atoms represented by each of $R^{42}$ and $R^{43}$ in the formula (32) include a methyl group, an ethyl group, a propyl group and a butyl group. Of those, a methyl group and an ethyl group are preferred.

Those repeating structural units may be introduced through a polymerization reaction in the presence of a maleate monomer.

Examples of the monomer include dimethyl maleate, diethyl maleate and dibutyl maleate.

Examples of the alkyl group having 1 to 10 carbon atoms represented by each of $R^{51}$ and $R^{52}$ in the formula (33) include a methyl group, an ethyl group, a propyl group and a butyl group. $R^{51}$ and $R^{52}$ each preferably represent a hydrogen atom.

Those repeating structural units may be introduced through a polymerization reaction in the presence of an acrylamide monomer.

Examples of the alkyl group having 1 to 10 carbon atoms represented by $R^{53}$ in the formula (34) include a methyl group, an ethyl group, a propyl group and a butyl group. Of those, a methyl group and an ethyl group are preferred.

Those repeating structural units may be introduced through a polymerization reaction in the presence of an alkyl vinyl ether monomer or a vinyl alcohol monomer.

Examples of the monomer include methyl vinyl ether, ethyl vinyl ether and vinyl alcohols obtained by saponifying vinyl esters with basic compounds and the like. Those monomers may also be used in combination.

Of those, a repeating structural unit represented by the formula (31) is particularly preferred.

Preferred examples of the polyolefin resin include polyolefin resins including (A1) represented by the following formula (111) wherein $R^{11}$ to $R^{14}$ each represent a hydrogen atom, (A2) represented by the following formula (221) wherein $R^{25}$ and $R^{26}$ each represent a hydrogen atom, and $X^{21}$ represents —$Y^{22}$COOCO$Y^{23}$— wherein $Y^{22}$ and $Y^{23}$ each represent a single bond, and a (A3) represented by one of the following formulae (311) and (312) wherein $R^{31}$ represents a hydrogen atom and $R^{41}$ represents a methyl group or an ethyl group.

(111)

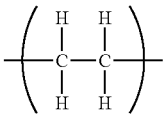

-continued (221)

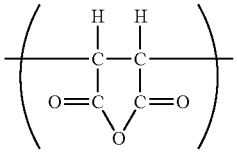

(311)

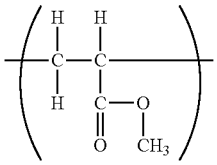

(312)

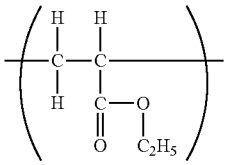

The content of the (A2) is preferably 0.01% to 30% by mass, more preferably 10% by mass or less, or most preferably 5% by mass or less with respect to the entire component of the polyolefin resin of the present invention ((A1)+(A2)+(A3)). In the case where the content of the (A2) is less than 0.01% by mass, black dots tend to occur, and in the case where the content of the (A2) exceeds 30% by mass, a ghost phenomenon tends to occur.

Further, in the polyolefin resin used in the present invention, the mass ratio of the (A1) to the (A3), (A1)/(A3), is preferably in the range of 55/45 to 99/1. In the case where the mass ratio is smaller than 55/45, a ghost phenomenon tends to get worse. The mass ratio is more preferably in the range of 70/30 to 97/3.

In the polyolefin resin used in the present invention, monomers other than the (A1) to (A3) may be copolymerized in a small amount. Examples of the monomers include dienes, (meth)acrylonitrile, halogenated vinyls, halogenated vinylidenes, carbon monoxide and carbon disulfide. In addition, although the molecular weight of the polyolefin resin used in the present invention is not particularly limited, a polyolefin resin with a molecular weight of 10,000 to 100,000 can be used, and a polyolefin resin with a molecular weight of 20,000 to 50,000 is preferred.

Although the synthesis method of the polyolefin resin used in the present invention is not particularly limited, the polyolefin resin is generally obtained by subjecting monomers constituting the polyolefin resin to high-pressure radical copolymerization in the presence of a radical generator. The polyolefin resin is synthesized by a known method described in chapters 1 to 4 of "New Polymer Experiment 2, Synthesis and Reaction of Polymer (1), Kyoritsu Shuppan Co., Ltd.", Japanese Patent Application Laid-Open No. 2003-105145, and Japanese Patent Application Laid-Open No. 2003-147028. Further, the composition of the polyolefin resin of the present invention can be measured by the following methods.

(1) Compositions of the (A1) to (A3) in Polyolefin Resin

The compositions of the (A1) to (A3) were determined by performing 1H-NMR and 13C-NMR analysis (300 MHz, produced by Varian Inc.) at 120° C. in orthodichlorobenzene (d4). In the 13C-NMR analysis, the compositions were measured by a gate-induced decoupling method considering the quantitativity.

(2) Composition of the (A2) in Polyolefin Resin

The acid value of the polyolefin resin was measured in accordance with JIS K5407 and converted into the mass of the (A2) in the polyolefin resin.

The metal oxide particle contained in the second intermediate layer of the present invention has a volume-average particle diameter of 20 nm or less, or preferably 10 nm or less. In the case where the volume-average particle diameter of the metal oxide particle is larger than 20 nm, the effect on a ghost phenomenon is small. Further, although the lower limit of the volume-average particle diameter of the metal oxide particle is not particularly limited, the lower limit is preferably 1 nm or more.

Examples of the metal oxide particle contained in the second intermediate layer of the present invention include a particle of aluminum oxide, titanium oxide, zinc oxide, cerium oxide, yttrium oxide, silicon oxide, zirconium oxide, iron oxide, tin oxide, magnesium oxide, copper oxide, manganese oxide, antimony-doped tin oxide, indium-doped tin oxide, aluminum-doped tin oxide, and a mixture or a complex oxide of at least two kinds of these oxides. The metal oxide particles can be used in the metal oxide particle contained in the first intermediate layer described later in the same way. These metal oxides particles can also be surface-treated with a surface treatment agent, if required.

The content of the polyolefin resin in the second intermediate layer of the present invention is preferably 20% to 80% in terms of mass ratio. Further, the content of the metal oxide particle in the second intermediate layer is preferably 20% to 80% in terms of a mass ratio. It should be noted that the volume-average particle diameter of the metal oxide particle can be adjusted in the range of the volume-average particle diameter defined in the present invention by using metal oxides particle having different volume-average particle diameters or by adjusting the dispersion time at a time of preparation of a coating liquid and adjusting a solvent ratio.

Next, the first intermediate layer of the present invention is described.

The first intermediate layer of the present invention is a layer on the support side among the intermediate layers, and contains a metal oxide particle. The volume-average particle diameter of the metal oxide particle contained in the first intermediate layer is 10 times to 200 times as large as the volume-average particle diameter of the metal oxide particle contained in the second intermediate layer. When the volume-average particle diameter of the metal oxide particle contained in the first intermediate layer is less than 10 times as large as the volume-average particle diameter of the metal oxide particle contained in the second intermediate layer, hole injection may occur from the first intermediate layer to the second intermediate layer. Further, when the volume-average particle diameter of the metal oxide particle contained in the first intermediate layer is larger than 200 times as large as the volume-average particle diameter of the metal oxide particle contained in the second intermediate layer, charge is concentrated locally, which may cause charge leakage, leading to the generation of black spots. It is preferred that the volume-average particle diameter of the metal oxide particle contained in the first intermediate layer is 20 times to 200 times as large as the volume-average particle diameter of the metal oxide particle contained in the second intermediate layer.

For the metal oxide particle contained in the first intermediate layer, a metal oxide particle which is same as the metal oxide particle contained in the second intermediate layer can be used. Further, in order to impart or enhance conductivity, the metal oxide particle may be coated with layer of antimony-doped tin oxide, oxygen-deficient tin oxide or the like, if required. It should be noted that the volume average particle diameter of the metal oxide particle contained in the first intermediate layer can be adjusted in the same way as in the case of the metal oxide particle contained in the second intermediate layer.

The first intermediate layer of the present invention can contain a binder resin generally contained in an intermediate layer of an electrophotographic photosensitive member. Examples of the binder resin used in the first intermediate layer include a phenol resin, a polyurethane resin, a melamine resin and a polyamide resin. These resins have satisfactory adhesive property with respect to the support, enhance the dispersibility of the metal oxide particle, and have satisfactory solvent resistance after film formation. Of those, a phenol resin and a polyurethane resin are preferred.

It is preferred that the content of the binder resin in the first intermediate layer of the present invention is 20% to 80% in terms of mass ratio. Further, it is preferred that the content of the metal oxide particle in the first intermediate layer is 20% to 80% in terms of mass ratio.

The volume-average particle diameters of the metal oxide particle contained in the intermediate layer of the present invention is each measured with a suitable magnification by transmission electron microscope (TEM) observation. Each of the volume-average particle diameters is determined by observing only 100 primary particles excluding secondary aggregated particles to determine a projected area thereof, and calculating a circle-equivalent diameter of the resultant area to determine an average particle diameter based on a volume.

A coating liquid for the intermediate layer of the present invention can be prepared by any method. For example, there is a method of preparing a coating liquid for the intermediate layer by loading a resin and a metal oxide particle to an appropriate solvent, followed by heating and stirring, to provide a dispersion. The resultant coating liquid may be applied onto a support by a dip application method (dip coating method), a roll coating method, a spray coating method, a curtain coating method and a spin coating method to form an intermediate layer. The thicknesses of the first intermediate layer used in the electrophotographic photosensitive member of the present invention is preferably 1 to 25 μm, or more preferably 1 to 15 μm. Further, the thickness of the second intermediate layer is preferably 0.1 to 10 μm, or more preferably 0.5 to 5 μm. Further, the ratio in thickness of the first intermediate layer to the second intermediate layer is preferably 1:5 to 50:1.

As for the support used in the present invention, it is sufficient so long as it has conductivity (conductive support), for example, supports of metals such as aluminum, nickel, copper, gold and iron, or alloys of the metals, can be enumerated. Further, conductive supports each having a thin film formed of a metal such as aluminum, silver or gold, or of a conductive material such as indium oxide or tin oxide, on an insulating support of, for example, polyester, polycarbonate, polyimide, or glass, can be enumerated. Moreover, conductive supports each obtained by dispersing carbon or a conductive filler in a resin to impart conductivity to the resin, can be enumerated. The surface of such conductive support may be subjected to an electrochemical treatment such as anodization or a chemical treatment involving the use of a solution prepared by dissolving a compound of a metal salt or a metal salt of a fluorine compound in an acidic aqueous solution mainly formed of an alkaline phosphate, phosphoric acid, or tannic acid, in order that the electrical characteristics of the conductive support, or adhesiveness between the conductive support and the intermediate layer may be improved.

The photosensitive layer used in the electrophotographic photosensitive member of the present invention may be a single layer type photosensitive layer, or a layered type photosensitive layer, but it is preferable that the photosensitive layer is the layered type photosensitive layer having a charge generation layer containing a charge generation substance and a charge transport layer (hole transport layer) containing a charge-transporting material (hole transporting material), which are arranged in this order from the support side.

The charge generation layer can be formed, for example, by dissolving a binder resin in a solvent, adding thereto a charge-generating material, and dispersing the charge-generating material in the mixture thereby to obtain a coating liquid for the charge generation layer, applying the coating liquid and drying it.

Examples of the charge-generating material include: (1) azo pigments such as monoazo, disazo and trisazo; (2) phthalocyanine-based pigments such as metal phthalocyanine and non-metal phthalocyanine; (3) indigo-based pigments such as indigo and thioindigo; (4) perylene-based pigments such as perylenic anhydride and perylenic imide; (5) polycyclic quinone-based pigments such as anthraquinone and pyrenequinone; (6) squarylium dyes; (7) pyrylium salts and thiapyrylium salts; (8) triphenylmethane-based dyes; (9) inorganic substances such as selenium, selenium-tellurium and amorphous silicon; (10) quinacridone pigments; (11) azulenium salt pigments; (12) cyanine dyes; (13) xanthene dyes; (14) quinoneimine dyes; (15) styryl dyes; (16) cadmium sulfide; and (17) zinc oxide. Of those, metal phthalocyanine pigments are particularly preferred. Of the metal phthalocyanine pigments, oxytitanium phthalocyanine, chlorogallium phthalocyanine, dichlorotin phthalocyanine and hydroxygallium phthalocyanine are preferred, and further, hydroxygallium phthalocyanine is particularly preferred.

As the oxytitanium phthalocyanine, in the X-ray diffraction spectrum having CuKα as a radiation source, an oxytitanium phthalocyanine crystal having strong diffraction peaks at Bragg angles (2θ35 0.2°) of 9.0°, 14.2°, 23.9° and 27.1°, and an oxytitanium phthalocyanine crystal having strong peaks at Bragg angles (2θ±0.2°) of 9.5°, 9.7°, 11.7°, 15.0°, 23.5°, 24.1° and 27.3° are preferred.

As the chlorogallium phthalocyanine, in the X-ray diffraction spectrum having CuKα as a radiation source, a chlorogallium phthalocyanine crystal having strong diffraction peaks at Bragg angles (2θ±0.2°) of 7.4°, 16.6°, 25.5° and 28.2°, a chlorogallium phthalocyanine crystal having strong diffraction peaks at Bragg angles (2θ±0.2°) of 6.8°, 17.3°, 23.6° and 26.9°, and a chlorogallium phthalocyanine crystal having strong diffraction peaks at Bragg angles (2θ±0.2°) of 8.7° to 9.2°, 17.6°, 24.0°, 27.4° and 28.8° are preferred.

As the dichlorotin phthalocyanine, in the X-ray diffraction spectrum having CuKα as a radiation source, a dichlorotin phthalocyanine crystal having strong diffraction peaks at Bragg angles (2θ±0.2°) of 8.3°, 12.2°, 13.7°, 15.9°, 18.9° and 28.2°, a dichlorotin phthalocyanine crystal having strong diffraction peaks at Bragg angles (2θ±0.2°) of 8.5°, 11.2°, 14.5° and 27.2°, a dichlorotin phthalocyanine crystal having strong diffraction peaks at Bragg angles (2θ±0.2°) of 8.7°, 9.9°, 10.9°, 13.1°, 15.2°, 16.3°, 17.4°, 21.9° and 25.5°, and a dichlorotin phthalocyanine crystal having strong diffraction peaks at Bragg angles (2θ±0.2°) of 9.2°, 12.2°, 13.4°, 14.6°, 17.0° and 25.3° are preferred.

As the hydroxygallium phthalocyanine, in the X-ray diffraction spectrum having CuKα as a radiation source, a hydroxygallium phthalocyanine crystal having strong diffraction peaks at Bragg angles (2θ±0.2°) of 7.3°, 24.9° and 28.1°, and a hydroxygallium phthalocyanine crystal having strong diffraction peaks at Bragg angles (2θ±0.2°) of 7.5°, 9.9°, 12.5°, 16.3°, 18.6°, 25.1° and 28.3° are preferred.

In the present invention, two or more kinds of the charge-generating materials may be used.

Examples of the binder resin used in the charge generation layer include a butyral resin, a polyester resin, a polycarbonate resin, a polyarylate resin, a polystyrene resin, a polyvinyl methacrylate resin, a polyvinyl acrylate resin, a polyvinyl acetate resin, a polyvinyl chloride resin, a polyamide resin, a polyurethane resin, a silicone resin, an alkyd resin, an epoxy resin, a cellulose resin and a melamine resin. Of those, a butyral resin is particularly preferred.

The dispersion particle diameter of the charge-generating material in the charge generation layer is preferably 0.5 μm or less, more preferably 0.3 μm or less, or still more preferably in the range of 0.01 to 0.2 μm. The thickness of the charge generation layer is preferably 0.01 to 2 μm, or more preferably 0.05 to 0.3 μm. Further, the ratio of the charge-generating material to the binder resin is preferably in the range of 3:1 to 1:1 (mass ratio).

The charge transport layer can be formed by applying and drying a coating liquid for a charge transport layer obtained by dispersing/dissolving an appropriate charge-transporting material in a solvent together with an appropriate binder resin (that can be selected from the resins for a charge generation layer).

Examples of the charge-transporting material (hole transporting material) include: high molecular compounds having heterocyclic or fused polycyclic aromatic groups such as poly-N-vinyl carbazole and polystyrylanthracene; and low molecular compounds including heterocyclic compounds such as pyrazoline, imidazole, oxazole, triazole and carbazole, triarylalkane derivatives such as triphenylmethane, triarylamine derivatives such as triphenylamine, phenylene diamine derivatives, N-phenylcarbazole derivatives, stilbene derivatives, and hydrazone derivatives.

Regarding the ratio of the charge-transporting material to the binder resin, the mass of the charge-transporting material is in the range of preferably 20 to 80, or more preferably 30 to 70 when the total mass of the charge-transporting material and the binder resin is defined as 100. When the amount of the charge-transporting material is less than the above-mentioned range, the charge transportability is degraded, which is likely to cause problems of a decrease in sensitivity and an increase in residual potential.

The thickness of the charge transport layer is preferably 1 to 50 μm, or more preferably 3 to 30 μm.

In the present invention, further, a surface protective layer may be formed on the charge transport layer. The surface protective layer may be formed of a single resin, or the charge-transporting material as described above and a conductive material such as conductive particle may be added to the surface protective layer for the purpose of decreasing a residual potential. Examples of the conductive particle include: metal particle, flaky metal particle and short metal fiber of aluminum, copper, nickel, silver or the like; particle of conductive metal oxide such as antimony oxide, indium oxide and tin oxide; polymer conducting agents such as polypyrrole, polyaniline and a polymer electrolyte; carbon black; carbon fiber; graphite particle; an organic or inorganic electrolyte; or conductive particle coated with these conductive substances.

The process cartridge of the present invention is a process cartridge including the electrophotographic photosensitive member of the present invention; and at least one unit selected from the group consisting of charging unit, developing unit, transferring unit and cleaning unit, in which the process cartridge integrally supports the electrophotographic photosensitive member and the at least one unit, and is attachable to and detachable from a main body of an electrophotographic apparatus. In addition, the electrophotographic apparatus of the present invention is an electrophotographic apparatus including the electrophotographic photosensitive member of the present invention, charging unit, exposing unit, developing unit and transferring unit.

Figure 2:
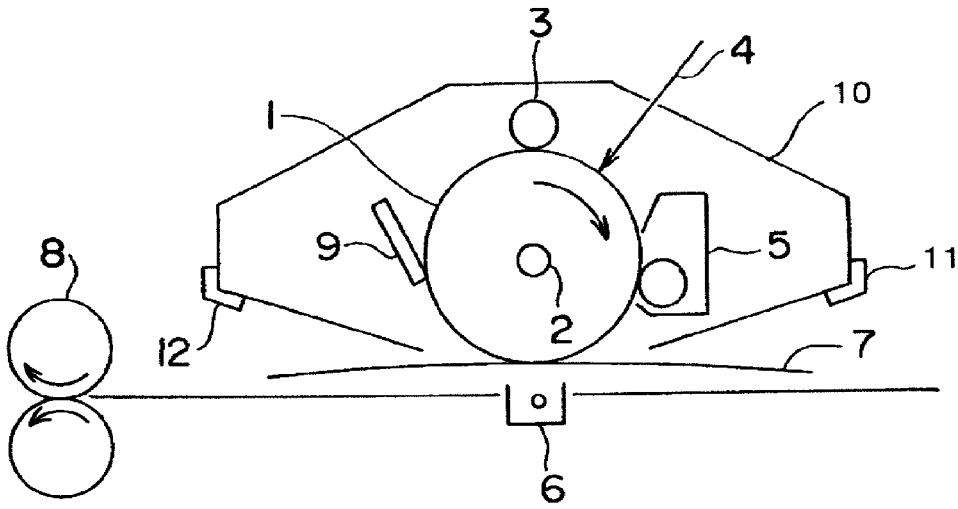
FIG. 2 is a view illustrating an example of a schematic configuration of an electrophotographic apparatus provided with a process cartridge including an electrophotographic photosensitive member of the present invention.

FIG. 2 illustrates an example of a schematic configuration of an electrophotographic apparatus provided with the process cartridge including the electrophotographic photosensitive member of the present invention. In FIG. 2, a drum-shaped electrophotographic photosensitive member 1 of the present invention is rotated around a shaft 2 in the direction indicated by an arrow at a predetermined circumferential speed. The circumferential surface of the electrophotographic photosensitive member 1 is uniformly charged to a predetermined positive or negative potential by charging unit (primary charging unit) 3 in the rotation process, and then receives exposure light 4 from exposing unit (not shown) such as slit exposure or laser beam scanning exposure. Thus, electrostatic latent images are sequentially formed on the circumferential surface of the electrophotographic photosensitive member 1. Next, the electrostatic latent images thus formed are each developed with toner from developing unit 5. The toner images formed by the development are sequentially transferred by transferring unit 6 onto a transfer material 7 taken out of a paper-feeding portion (not shown) to be fed to a portion between the electrophotographic photosensitive member 1 and the transferring unit 6 in synchronization with the rotation of the electrophotographic photosensitive member 1. The transfer material 7 onto which the images have been transferred is separated from the surface of the electrophotographic photosensitive member, and is then introduced into fixing unit 8 to undergo image fixation. As a result, the transfer material as a copy is printed out of the apparatus.

Transfer residual toner may be removed from the electrophotographic photosensitive member 1 by cleaning unit 9 after the transfer of the images, and further, the electrophotographic photosensitive member may be subjected to an antistatic treatment by pre-exposure light from pre-exposing unit before the electrophotographic photosensitive member is repeatedly used for image formation. In the present invention, the following procedure may be adopted: two or more of the components including the electrophotographic photosensitive member 1, the charging unit 3, the developing unit 5 and the cleaning unit 9 described above are integrally bonded to form a process cartridge, and the process cartridge is formed so as to be attachable to and detachable from the main body of the electrophotographic apparatus such as a copying machine or a laser beam printer. For example, at least one of the charging unit 3, the developing unit 5 and the cleaning unit 9, and the electrophotographic photosensitive member 1 may be integrally supported to serve as a process cartridge 10 attachable to and detachable from the main body of the apparatus with the aid of guiding unit such as a rail 11 of the main body of the apparatus. In addition, when the electrophotographic apparatus is a copying machine or a printer, the exposure light 4 is light reflected from or transmitting through an original copy, or light applied by, for example, scanning with laser beams performed in accordance with a signal obtained by reading the original copy with a sensor and turning the read original copy into the signal, or the driving of an LED array or liquid crystal shutter array.

The electrophotographic photosensitive member of the present invention is used not only in an electrophotographic copying machine, but also widely in the fields of electrophotographic applications such as a laser beam printer, a CRT printer, an LED printer, a liquid crystal printer and a laser plate-making.

EXAMPLES

Hereinafter, the present invention is described specifically by way of examples. However, the present invention is not limited thereto.

<Production of Polyolefin Resin>

As the polyolefin resin used in the second intermediate layer in Examples 1 to 30 described later, commercially available resins (BONDINE HX-8290, BONDINE HX-8210, BONDINE AX-8390 (trade name) produced by Sumitomo Chemical Co., Ltd.; Primacor 5980I (trade name) produced by the Dow Chemical Company), and resins (B1 to B11) having compositions described in Table 1 synthesized by known methods were used. It should be noted that the resins B1 to B11 were synthesized by methods described in chapters 1 to 4 of "New Polymer Experiment 2 Synthesis and Reaction of Polymer (1)" (Kyoritsu Shuppan Co., Ltd.), and Japanese Patent Application Laid-Open Nos. 2003-105145 and 2003-147028.

The compositions of the polyolefin resins in Examples 1 to 30 were measured by the following method. Tables 1 and 2 show the results.

(1) Compositions of the (A1) to (A3) in Polyolefin Resin

The compositions of the (A1) to (A3) were determined by performing 1H-NMR and 13C-NMR analysis (300 MHz, produced by Varian Inc.) at 120° C. in orthodichlorobenzene (d4). In the 13C-NMR analysis, the compositions were measured by a gate-induced decoupling method considering the quantitativity.

(2) Composition of the (A2) in Polyolefin Resin

The acid value of the polyolefin resin was measured in accordance with JIS K5407 and converted into the mass of the (A2) in the polyolefin resin.

TABLE 1

| | A1 | | A2 | | A3 | | | |
|---|---|---|---|---|---|---|---|---|
| | Structural unit | Composition Ratio (mass %) | Structural unit | Composition Ratio (mass %) | Structural unit | Composition Ratio (mass %) | A2/(A1 + A2 + A3) × 100 | A1/A3 |
| BONDINE HX-8290 | 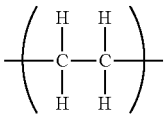 | 80.00 | 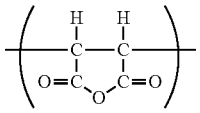 | 2.00 | 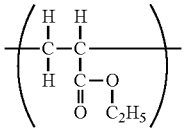 | 18.00 | 2 | 4.4 |
| BONDINE HX-8210 | ↑ | 91.00 | ↑ | 3.00 | ↑ | 6.00 | 3 | 15.2 |
| BONDINE HX-8390 | ↑ | 68.00 | ↑ | 2.00 | ↑ | 30.00 | 2 | 2.3 |
| Primacor | ↑ | 80.00 | 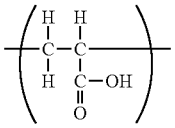 | 20.00 | — | 0.00 | 20 | — |
| Resin B1 | ↑ | 85.00 | 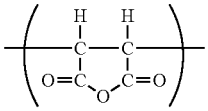 | 3.00 | 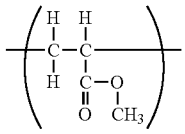 | 12.00 | 3 | 7.1 |
| Resin B2 | ↑ | 85.00 | ↑ | 3.00 | 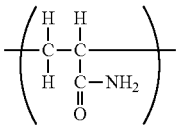 | 12.00 | 3 | 7.1 |
| Resin B3 | ↑ | 85.00 | ↑ | 3.00 | 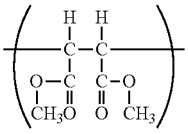 | 12.00 | 3 | 7.1 |
| Resin B4 | ↑ | 85.00 | ↑ | 8.00 | 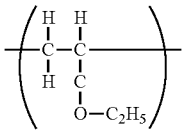 | 7.00 | 8 | 12.1 |

TABLE 2

| | A1 | | A2 | | A3 | | | |
|---|---|---|---|---|---|---|---|---|
| | Structural unit | Composition Ratio (mass %) | Structural unit | Composition Ratio (mass %) | Structural unit | Composition Ratio (mass %) | A2/(A1 + A2 + A3) × 100 | A1/A3 |
| Resin B5 | ↑ | 92.00 | ↑ | 5.00 | 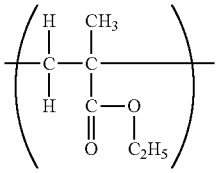 | 3.00 | 5 | 30.7 |
| Resin B6 | ↑ | 85.00 | ↑ | 10.00 | 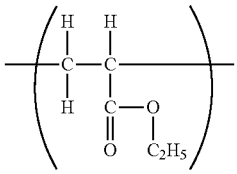 | 5.00 | 10 | 17.0 |
| Resin B7 | ↑ | 60.00 | ↑ | 30.00 | ↑ | 10.00 | 30 | 6.0 |
| Resin B8 | 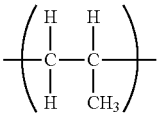 | 47.00 | 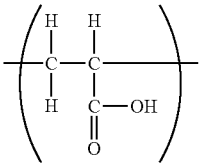 | 15.00 | ↑ | 38.00 | 15 | 1.2 |
| Resin B9 | 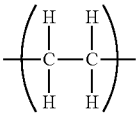 | 85.00 | 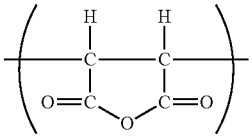 | 1.00 | ↑ | 14.00 | 1 | 6.1 |
| Resin B10 | ↑ | 85.00 | ↑ | 0.10 | 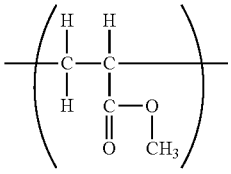 | 14.90 | 0.1 | 5.7 |
| Resin B11 | ↑ | 85.00 | ↑ | 0.01 | ↑ | 14.99 | 0.01 | 5.7 |

Example 1

First, 75.0 g of the polyolefin resin (BONDINE HX-8290 (trade name) produced by Sumitomo Chemical Co., Ltd.), 60.0 g of 2-propanol (hereinafter referred to as "IPA"), 5.1 g of triethylamine (hereinafter referred to as "TEA"), and 159.9 g of distilled water were loaded into a sealable, pressure-resistant glass container provided with a stirring machine and a heater and having a volume of one liter, and the mixture was stirred while the rotational speed of a stirring blade was set to 300 rpm. As a result, no granular resin precipitate was observed at the bottom of the container, but the resin was observed to be in a floating state. Here, 10 minutes after the observation, the heater was turned on to heat the mixture while the state was maintained. Then, the mixture was stirred for an additional 20 minutes while the temperature in the system was kept at 140 to 145° C. After that, the system was immersed in a water bath, and the temperature in the system was lowered to room temperature (25° C.) while the mixture was stirred with the rotational speed kept at 300 rpm. After that, the mixture was filtrated with a 300-mesh stainless filter (wire diameter of 0.035 mm, plain weave) under pressure (at an air pressure of 0.2 MPa). As a result, an opaque, uniform polyolefin resin particle dispersion liquid was obtained.

0.2 mol of tin (IV) chloride pentahydrate was dissolved in 200 ml of water so that a 0.5 M aqueous solution was obtained. Then, 28% ammonia water was added to the aqueous solution while the aqueous solution was stirred. As a result, white tin oxide ultrafine particle-containing slurry having a pH of 1.5 was obtained. After the resultant tin oxide ultrafine particle-containing slurry had been heated to 70° C., the slurry was naturally cooled to around 50° C., and then pure water was added to the slurry so that one liter of tin oxide ultrafine particle-containing slurry was obtained. Then, the slurry was subjected to solid-liquid separation with a centrifugal separator. Next, 800 ml of pure water were added to the water-containing solid, and the mixture was subjected to stirring and dispersion with a homogenizer. After that, washing was performed through the solid-liquid separation of the mixture with a centrifugal separator. Then, 75 ml of pure water were added to a water-containing solid after the washing so that tin oxide ultrafine particle-containing slurry was prepared. Next, 3.0 ml of triethylamine were added to the resultant tin oxide ultrafine particle-containing slurry, and the mixture was stirred. When the mixture started to be transparent, the mixture was heated to 70° C. After that, the heating was stopped, and the mixture was naturally cooled. As a result, a tin oxide sol solution stabilized by an organic amine having a solid concentration of 20% by mass as a dispersion stabilizer was obtained.

The obtained polyolefin resin particle dispersion liquid was mixed with the obtained tin oxide sol dispersion liquid so that the amount of tin oxide became 6.8 parts with respect to 1 part of a polyolefin resin solid content. After that, a solvent was added to the mixture so that the ratio of the solvent became water/IPA=9/1 and a solid content became 5%, and the resultant mixture was stirred to yield a coating liquid for a second intermediate layer.

A support (conductive support) was obtained by ultrasonic water washing of an aluminum cylinder with a diameter of 30 mm and a length of 260.5 mm.

A solution containing 120 parts of titanium oxide particle coated with oxygen-deficient tin oxide (tin oxide coverage (mass ratio): 25%), 70 parts of a resol type phenol resin (Briophen J-325 (trade name) produced by Dainippon Ink and Chemicals, Inc., solid content: 70%), and 100 parts of 2-methoxy-1-propanol was dispersed in a ball mill for 20 hours to prepare a coating liquid for a first intermediate layer.

The liquid was applied onto the support by dip coating, and cured by heating at 140° C. for 30 minutes, and thus, a first intermediate layer with a thickness of 15 μm was formed.

The coating liquid for a second intermediate layer was applied onto the first intermediate layer thus formed by dip coating, and dried at 120° C. for 10 minutes to form a second intermediate layer with a thickness of 0.8 μm.

Next, 350 parts of cyclohexanone as the charge-generating material were added to mixture of 20 parts of a hydroxygallium phthalocyanine crystal and 10 parts of a polyvinyl butyral resin (BX-1 (trade name) produced by SEKISUI CHEMICAL CO., LTD.), and the obtained mixture was subjected to a dispersion treatment with a sand mill using glass beads each having a diameter of 1 mm (1 mmΦ) for 3 hours. Then, 1200 parts of ethyl acetate were added to dilute the mixture. In this case, the dispersed particle diameter of the charge-generating material measured with CAPA-700 ((trade name), produced by HORIBA, Ltd.) was 0.15 μm. The coating liquid for a charge generation layer was applied onto the second intermediate layer by dip coating, and was then dried for 10 minutes at 100° C. As a result, a charge generation layer having a thickness of 0.2 μm was formed.

Next, 8 parts of a compound represented by the following structural formula (4) as the charge-transporting material (hole transporting material)

(4)

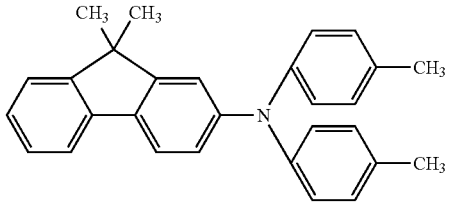

and 10 parts of a bisphenol C type polyallylate resin having a repeating structural unit represented by the following structural formula (5) (having a weight-average molecular weight (Mw) of 110,000) were dissolved in a mixed solvent formed of 50 parts of monochlorobenzene and 10 parts of dichloromethane. As a result, a coating liquid for a charge transport layer was prepared. The coating liquid was applied onto the charge generation layer by dip coating, and was then dried for 1 hour at 110° C. As a result, a charge transport layer having a thickness of 15 μm was formed. Thus, the electrophotographic photosensitive member was produced.

(5)

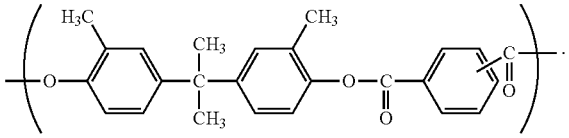

The electrophotographic photosensitive member thus produced was left to stand under the environment of normal temperature and humidity (temperature: 23° C./humidity: 50% RH) for 24 hours, and the output image was evaluated under the same environment.

For evaluation of the output image, a laser beam printer (Color laser jet 4600 (trade name)) produced by Hewlett-Packard Development Company, remodeled so that a dark potential became −800 V (process speed: 94.2 mm/s) was used. Charging unit of the laser beam printer is contact charging unit provided with a charging roller, and the charging roller is supplied with only a DC voltage. Further, the laser beam printer is an electrophotographic device having no antistatic unit at a position on an upstream side of the charging unit and a position on a downstream side of the transferring unit in the rotation direction of the electrophotographic photosensitive member.

The electrophotographic photosensitive member thus produced was mounted on a process cartridge for cyan color for the laser beam printer, and the resultant process cartridge was mounted on a station of a process cartridge for cyan color of the laser beam printer. Thus, an image for evaluation was output.

As an image for evaluating black dots, a solid white image was output, and the presence or absence of image defects was evaluated by visual inspection.

The evaluation of black dots was made by observation in accordance with the following standards.

A: No black dots are observed by visual inspection.

B: A trace amount (1 to 5 places) of black dots is recognized.

C: Black dots are partially recognized by visual inspection at several places (at least 6 places).

D: Black dots are observed over an entire surface by visual inspection.

Of those, in C and D, it was determined that the effect of the present invention was not obtained sufficiently.

As an image for evaluating a ghost, as illustrated in FIG. 1, a half-tone image was used, which was obtained by outputting black square images in the leading end of an image, followed by printing with one-dot knight jump pattern.

For evaluation of a ghost phenomenon, a spectral densitometer (X-Rite 504/508 (trade name)) produced by X-Rite CO. Ltd. was used. In the output image, the concentration of a portion not corresponding to a ghost portion (a portion in which the ghost phenomenon occurs) was subtracted from the concentration of the ghost portion to obtain a ghost image concentration. This process was performed at 10 points in one output image and an average value at 10 points was obtained.

The standard of the evaluation results is as follows: when a ghost image concentration is 0.05 or more, there is a difference apparent to the eye, and when the ghost image concentration is less than 0.05, there is no difference apparent to the eye.

Further, the image was output on 10,000 sheets, and the images after paper passing of the first (initial) sheet and the 10,000th sheet were evaluated.

During paper passing, full-color print operation was performed in an intermittent mode in which a character image with a print percentage of 2% in each color was output on one sheet of letter paper for every 20 seconds, and 10,000 sheets were passed. The ghost phenomenon was evaluated immediately after paper passing of 10,000 sheets.

Further, similarly, an electrophotographic photosensitive member was produced as a TEM observation sample for particle diameter measurement, and the volume-average particle diameters of the metal oxide particles contained in the first and second intermediate layers were measured. Table 3 shows the results.

Example 2

An electrophotographic photosensitive member was produced in the same way as in Example 1, except that the preparation of the coating liquid for a second intermediate layer was changed as follows, and was evaluated. Table 3 shows the results.

The polyolefin resin particle dispersion liquid was mixed with the tin oxide sol dispersion liquid of Example 1 so that the amount of tin oxide became 6.8 parts with respect to one part of a polyolefin resin solid content. After that, a solvent was added to the mixture so that the ratio of the solvent became water/IPA=9.5/0.5 and a solid content became 5%, and the resultant mixture was stirred to obtain a coating liquid for a second intermediate layer.

Example 3

An electrophotographic photosensitive member was produced in the same way as in Example 1, except that the preparation of the coating liquid for a second intermediate layer was changed as follows, and was evaluated. Table 3 shows the results.

The polyolefin resin particle dispersion liquid was mixed with the tin oxide sol dispersion liquid of Example 1 so that the amount of tin oxide became 6.8 parts with respect to one part of a polyolefin resin solid content. After that, a solvent was added to the mixture so that the ratio of the solvent became water/IPA=6/4 and a solid content became 5%, and the resultant mixture was stirred to obtain a coating liquid for a second intermediate layer.

Example 4

An electrophotographic photosensitive member was produced in the same way as in Example 1, except that the preparation of the coating liquid for a second intermediate layer was changed as follows, and was evaluated. Table 3 shows the results.

The polyolefin resin particle dispersion liquid was mixed with the tin oxide sol dispersion liquid of Example 1 so that the amount of tin oxide became 6.8 parts with respect to one part of a polyolefin resin solid content. After that, a solvent was added to the mixture so that the ratio of the solvent became water/IPA=5/5 and a solid content became 5%, and the resultant mixture was stirred to obtain a coating liquid for a second intermediate layer.

Example 5

An electrophotographic photosensitive member was produced in the same way as in Example 1, except that the preparation of the coating liquid for a second intermediate layer was changed as follows, and was evaluated. Table 3 shows the results.

10 parts of titanium oxide particle (ST-01 (trade name) produced by Ishihara Sangyo Co., Ltd.) and 90 parts of IPA were dispersed in a ball mill for 72 hours to obtain a titanium oxide particle dispersion liquid.

The titanium oxide particle dispersion liquid was used instead of the tin oxide sol solution as the coating liquid for a second intermediate layer, and the polyolefin resin particle dispersion liquid was mixed to the titanium oxide particle dispersion liquid so that the amount of titanium oxide particle became 4.2 parts with respect to one part of a polyolefin resin solid content. After that, a solvent was added so that a solvent ratio became water/IPA=7/3 and a solid content became 5%, followed by stirring, to obtain a coating liquid for a second intermediate layer.

Example 6

An electrophotographic photosensitive member was produced in the same way as in Example 5, except that the titanium oxide particle (ST-01 (trade name) produced by Ishihara Sangyo Co., Ltd.) of the second intermediate layer was replaced by another titanium oxide particle (ST-21 (trade name) produced by Ishihara Sangyo Co Ltd.), and evaluated. Table 3 shows the results.

Example 7

An electrophotographic photosensitive member was produced in the same way as in Example 5, except that the titanium oxide particle (ST-01 (trade name) produced by Ishihara Sangyo Co., Ltd.) of the second intermediate layer was replaced by another titanium oxide particle (MT150W (trade name) produced by Tayca Co Ltd.), and evaluated. Table 3 shows the results.

Example 8

An electrophotographic photosensitive member was produced in the same way as in Example 5, except that the titanium oxide particle (ST-01 (trade name) produced by Ishihara Sangyo Co., Ltd.) of the second intermediate layer was replaced by another titanium oxide particle (MT100HD (trade name) produced by Tayca Co Ltd.), and evaluated. Table 3 shows the results.

Example 9

An electrophotographic photosensitive member was produced in the same way as in Example 1, except that, in preparation of the coating liquid for a first intermediate layer, titanium oxide particle coated with oxygen-deficient tin oxide (tin oxide coverage (mass ratio): 25%) was replaced by titanium oxide particle coated with tin oxide doped with 10% by mass of antimony oxide (tin oxide coverage (mass ratio): 40%), and evaluated. Table 3 shows the results.

Example 10

An electrophotographic photosensitive member was produced in the same way as in Example 1, except that, in preparation of the coating liquid for a first intermediate layer, titanium oxide particle coated with oxygen-deficient tin oxide (tin oxide coverage (mass ratio): 25%) was replaced by titanium oxide particle coated with oxygen-deficient tin oxide (tin oxide coverage (mass ratio): 65%), and evaluated. Table 3 shows the results.

Example 11

An electrophotographic photosensitive member was produced in the same way as in Example 2, except that, in preparation of the coating liquid for a first intermediate layer, titanium oxide particle coated with oxygen-deficient tin oxide (tin oxide coverage (mass ratio): 25%) was replaced by titanium oxide particle coated with oxygen-deficient tin oxide (tin oxide coverage (mass ratio): 75%), and evaluated. Table 3 shows the results.

Example 12

An electrophotographic photosensitive member was produced in the same way as in Example 1, except that, in preparation of the coating liquid for a first intermediate layer, titanium oxide particle coated with oxygen-deficient tin oxide (tin oxide coverage (mass ratio): 25%) was replaced by titanium oxide particle (PT401L (trade name) produced by Ishihara Sangyo Co., Ltd.), and the thickness was changed from 15 μm to 1.5 μm, and evaluated. Table 3 shows the results.

Example 13

An electrophotographic photosensitive member was produced in the same way as in Example 1, except that, in preparation of the coating liquid for a first intermediate layer, titanium oxide particle coated with oxygen-deficient tin oxide (tin oxide coverage (mass ratio): 25%) was replaced by titanium oxide particle (PT301 (trade name) produced by Ishihara Sangyo Co., Ltd.), and the thickness was changed from 15 μm to 1.5 μm, and evaluated. Table 3 shows the results.

Example 14

An electrophotographic photosensitive member was produced in the same way as in Example 8, except that, in preparation of the coating liquid for a first intermediate layer, titanium oxide particle coated with oxygen-deficient tin oxide (tin oxide coverage (mass ratio): 25%) was replaced by titanium oxide particle (PT301 (trade name) produced by Ishihara Sangyo Co., Ltd.), and the thickness was changed from 15 μm to 1.5 μm, and evaluated. Table 3 shows the results.

Example 15

An electrophotographic photosensitive member was produced in the same way as in Example 8, except that the preparation of the coating liquid for a first intermediate layer was changed as follows, and evaluated. Table 3 shows the results.

A solution containing 120 parts of titanium oxide particle coated with oxygen-deficient tin oxide (tin oxide coverage (mass ratio): 25%), 50 parts of melamine resin (Yuban 20 HS (trade name) produced by Mitsui Chemicals Inc.), and 100 parts of tetrahydrofuran was dispersed in a ball mill for 20 hours to prepare a coating liquid for a first intermediate layer.

Example 16

An electrophotographic photosensitive member was produced in the same way as in Example 6, except that the preparation of the coating liquid for a first intermediate layer was changed as follows, and evaluated. Table 3 shows the results.

A solution containing 120 parts of titanium oxide particle coated with oxygen-deficient tin oxide (tin oxide coverage (mass ratio): 25%), 100 parts of polyester polyurethane (Nipporan2304 (trade name) produced by Nippon polyurethane Co., Ltd.), and 100 parts of 2-methoxy-1-propanol was dispersed in a ball mill for 20 hours to prepare a coating liquid for a first intermediate layer.

Example 17-30

An electrophotographic photosensitive member was produced in the same way as in Example 1, except that the preparation of the coating liquid for a second intermediate layer was changed as follows, and evaluated. Table 3 shows the results.

A polyolefin resin particle dispersion liquid was prepared in the same way as in Example 1, except that the polyolefin resin (BONDINE HX-8290 (trade name) produced by Sumitomo Chemical Co., Ltd.) was replaced by polyolefin resin (BONDINE AX-8210 (trade name) produced by Sumitomo Chemical Co., Ltd.): Example 17, polyolefin resin (BONDINE AX-8390 (trade name) produced by Sumitomo Chemical Co., Ltd.): Example 18, polyolefin resin (Primacor 5980I (trade name) produced by the Dow Chemical Company): Example 19, and polyolefin resins (B1) to (B11): Examples 20 to 30 in Table 1, and thus, a coating liquid for a second intermediate layer was obtained.

Comparative Example 1

An electrophotographic photosensitive member was produced in the same way as in Example 1, except that the first intermediate layer and the second intermediate layer were changed as follows, and evaluated. Table 3 shows the results.

(First Intermediate Layer)

A solution containing 120 parts of titanium oxide particle (ST-21 (trade name) produced by Ishihara Sangyo Co., Ltd.), 70 parts of resol type phenol resin (Briophen J-325 (trade name) produced by Dainippon Ink and Chemicals, Inc., solid content: 70%), and 100 parts of 2-methoxy-1-propanol was dispersed in a ball mill for 20 hours to prepare a coating liquid for a first intermediate layer. The solution was applied onto a support by dip coating, and cured by heating at 140° C. for 30 minutes, and thus, a first intermediate layer with a thickness of 1 μm was formed.

(Second Intermediate Layer)

A solution containing 4 parts of titaniumoxide particle (ST-21 (trade name) produced by Ishihara Sangyo Co., Ltd.), 1 part of polyamide resin (CM 8000 (trade name) produced by Toray Industries, Inc.), 7 parts of methanol, and 2 parts of butanol was dispersed in a ball mill for 20 hours to prepare a coating liquid for a second intermediate layer. The coating liquid for a second intermediate layer was applied onto the first intermediate layer by dip coating and dried at 120° C. for 10 minutes to form a second intermediate layer with a thickness of 1.5 μm.

Comparative Example 2

An electrophotographic photosensitive member was produced in the same way as in Comparative Example 1, except that the first intermediate layer was not provided, and evaluated. Table 3 shows the results.

Comparative Example 3

An electrophotographic photosensitive member was produced in the same way as in Comparative Example 2, except that titanium oxide particle (ST-21 (trade name) produced by Ishihara Sangyo Co., Ltd.) was replaced by another titanium oxide particle (TITANIX JR (trade name) produced by Tayca Co., Ltd.), and evaluated. Table 3 shows the results.

Comparative Example 4

An electrophotographic photosensitive member was produced in the same way as in Example 1, except that the first intermediate layer and the second intermediate layer were changed as follows, and evaluated. Table 3 shows the results.

(First Intermediate Layer)

A solution containing 120 parts of titanium oxide particle (TITANIX JR (trade name) produced by Tayca Co., Ltd.), 70 parts of a resol type phenol resin (Briophen J-325 (trade name) produced by Dainippon Ink and Chemicals, Inc., solid content: 70%), and 100 parts of 2-methoxy-1-propanol was dispersed in a ball mill for 20 hours to prepare a coating liquid for a first intermediate layer. The solution was applied onto a support by dip coating, and cured by heating at 140° C. for 30 minutes, and thus, a first intermediate layer with a thickness of 1 μm was formed.

(Second Intermediate Layer)

A solution containing 4 parts of titanium oxide particle (TTO55N (trade name) produced by Ishihara Sangyo Co., Ltd.), 1 part of a polyamide resin (CM 8000 (trade name) produced by Toray Industries, Inc.), 7 parts of methanol, and 2 parts of butanol was dispersed in a ball mill for 20 hours to prepare a coating liquid for a second intermediate layer. The coating liquid for a second intermediate layer was applied onto the first intermediate layer by dip coating and dried at 120° C. for 10 minutes to form a second intermediate layer with a thickness of 1.5 μm.

Comparative Example 5

An electrophotographic photosensitive member was produced in the same way as in Example 1, except that the first intermediate layer was not provided and the coating liquid for a second intermediate layer was prepared as follows, and evaluated. Table 3 shows the results.

(Second Intermediate Layer)

The polyolefin resin dispersion for a second intermediate layer was replaced by an ethylene acrylic acid copolymer resin dispersion (SG2000 (trade name) produced by Namariichi Co., Ltd.) and titanium oxide particle (ST-01 (trade name) produced by Ishihara Sangyo Co., Ltd.) was replaced by another titanium oxide particle (TTO55N (trade name) produced by Ishihara Sangyo Co., Ltd.), and thus, a coating liquid for a second intermediate layer was prepared. This solution was applied onto the support by dip coating and dried at 120° C. for 10 minutes to form a second intermediate layer with a thickness of 0.8 μm.

Comparative Example 6

An electrophotographic photosensitive member was produced in the same way as in Example 1, except that the first intermediate layer and the second intermediate layer were changed as follows, and evaluated. Table 3 shows the results.

(First Intermediate Layer)

A solution containing 120 parts of titanium oxide particle (TITANIX JR (trade name) produced by Tayca Co., Ltd.), 70 parts of a resol type phenol resin (Briophen J-325 (trade name) produced by Dainippon Ink and Chemicals, Inc., solid content: 70%), and 100 parts of 2-methoxy-1-propanol was dispersed in a ball mill for 20 hours to prepare a coating liquid for a first intermediate layer. The solution was applied onto a support by dip coating, and cured by heating at 140° C. for 30 minutes, and thus, a first intermediate layer with a thickness of 1 μm was formed.

(Second Intermediate Layer)

A solution containing 4 parts of titanium oxide particle (ST-21 (trade name) produced by Ishihara Sangyo Co., Ltd.), 1 part of a polyamide resin (CM 8000 (trade name) produced by Toray Industries, Inc.), 7 parts of methanol, and 2 parts of butanol was dispersed in a ball mill for 20 hours to prepare a coating liquid for a second intermediate layer. The coating liquid for a second intermediate layer was applied onto the first intermediate layer by dip coating and dried at 120° C. for 10 minutes to form a second intermediate layer with a thickness of 1.5 μm.

Comparative Example 7

An electrophotographic photosensitive member was produced in the same way as in Example 1, except that the first intermediate layer and the second intermediate layer were changed as follows, and evaluated. Table 3 shows the results.

(First Intermediate Layer)

A solution containing 80 parts of titanium oxide particle coated with antimony-doped tin oxide (Kronos ECT-62 (trade name) produced by Titan Kogyo, Co., Ltd.), 70 parts of a resol type phenol resin (Briophen J-325 (trade name) produced by Dainippon Ink and Chemicals, Inc., solid content: 70%), and 100 parts of 2-methoxy-1-propanol was dispersed in a ball mill for 20 hours to prepare a coating liquid for a first intermediate layer. The solution was applied onto the support by dip coating and cured by heating at 140° C. for 30 minutes to form a first intermediate layer with a thickness of 15 μm.

(Second Intermediate Layer)

A solution containing 4 parts of titanium oxide particle (TTO55N (trade name) produced by Ishihara Sangyo Co., Ltd.), 1 part of a polyamide resin (CM 8000 (trade name) produced by Toray Industries, Inc.), 7 parts of methanol, and 2 parts of butanol was dispersed in a ball mill for 20 hours to prepare a coating liquid for a second intermediate layer. The coating liquid for a second intermediate layer was applied onto the first intermediate layer by dip coating and dried at 120° C. for 10 minutes to form a second intermediate layer with a thickness of 1.5 μm.

TABLE 3

| | First intermediate layer | | Second intermediate layer | | Diameter of metal oxide in first intermediate layer/Diameter | Image evaluation | | |
|---|---|---|---|---|---|---|---|---|
| | Metal oxide | Particle diameter (nm) | Metal oxide | Particle diameter (nm) | of metal oxide in second intermediate layer | Initial fogging | Initial ghost | Ghost after passing 10,000 sheets |
| Exsamle | | | | | | | | |
| 1 | Titanium oxide (SnO2 coverage 25%) | 200 | Tin oxide | 5 | 40.0 | A | 0.00 | 0.00 |
| 2 | ↑ | 200 | ↑ | 4 | 50.0 | A | 0.00 | 0.00 |
| 3 | ↑ | 200 | ↑ | 10 | 20.0 | A | 0.00 | 0.00 |
| 4 | ↑ | 200 | ↑ | 15 | 13.3 | B | 0.00 | 0.01 |
| 5 | ↑ | 200 | Titanium oxide (ST01) | 9 | 22.2 | A | 0.00 | 0.00 |
| 6 | ↑ | 200 | Titanium oxide (ST21) | 20 | 10.0 | B | 0.00 | 0.02 |
| 7 | ↑ | 200 | Titanium oxide (MT150W) | 15 | 13.3 | B | 0.00 | 0.01 |
| 8 | ↑ | 200 | Titanium oxide (MT100HD) | 15 | 13.3 | B | 0.00 | 0.01 |
| 9 | Titanium oxide (SnO2 coverage 40%) | 360 | Tin oxide | 5 | 72.0 | A | 0.00 | 0.00 |
| 10 | Titanium oxide (SnO2 coverage 65%) | 570 | ↑ | 5 | 114.0 | A | 0.00 | 0.00 |
| 11 | Titanium oxide (SnO2 coverage 75%) | 800 | ↑ | 4 | 200.0 | A | 0.00 | 0.00 |
| 12 | Titanium oxide (PT401L) | 150 | ↑ | 5 | 30.0 | A | 0.00 | 0.00 |
| 13 | Titanium oxide (PT301) | 300 | ↑ | 5 | 60.0 | A | 0.00 | 0.00 |
| 14 | ↑ | 300 | Titanium oxide (MT 100HD) | 15 | 20.0 | A | 0.00 | 0.01 |
| 15 | Titanium oxide (SnO2 coverage 25%) | 200 | ↑ | 15 | 13.3 | B | 0.00 | 0.01 |
| 16 | ↑ | 200 | Titanium oxide (ST21) | 20 | 10.0 | B | 0.01 | 0.02 |
| 17 | ↑ | 200 | Tin oxide | 5 | 40.0 | A | 0.00 | 0.00 |
| 18 | ↑ | 200 | ↑ | 5 | 40.0 | A | 0.00 | 0.00 |
| 19 | ↑ | 200 | ↑ | 5 | 40.0 | B | 0.00 | 0.02 |
| 20 | ↑ | 200 | ↑ | 5 | 40.0 | A | 0.00 | 0.00 |
| 21 | ↑ | 200 | ↑ | 5 | 40.0 | A | 0.00 | 0.01 |
| 22 | ↑ | 200 | ↑ | 5 | 40.0 | A | 0.00 | 0.01 |
| 23 | ↑ | 200 | ↑ | 5 | 40.0 | A | 0.00 | 0.02 |
| 24 | ↑ | 200 | ↑ | 5 | 40.0 | A | 0.00 | 0.00 |
| 25 | ↑ | 200 | ↑ | 5 | 40.0 | A | 0.00 | 0.01 |
| 26 | ↑ | 200 | ↑ | 5 | 40.0 | A | 0.00 | 0.01 |
| 27 | ↑ | 200 | ↑ | 5 | 40.0 | A | 0.02 | 0.04 |
| 28 | ↑ | 200 | ↑ | 5 | 40.0 | A | 0.01 | 0.02 |
| 29 | ↑ | 200 | ↑ | 5 | 40.0 | A | 0.00 | 0.00 |
| 30 | ↑ | 200 | ↑ | 5 | 40.0 | A | 0.00 | 0.00 |
| Comparative Example | | | | | | | | |
| 1 | Titanium oxide (ST21) | 20 | Titanium oxide (ST21) | 20 | 1.0 | D | 0.03 | 0.07 |
| 2 | None | なし | ↑ | 20 | — | D | 0.03 | 0.06 |
| 3 | None | なし | Titanium oxide (TITANIX) | 200 | — | A | 0.06 | 0.10 |
| 4 | Titanium oxide (TITANIX) | 180 | Titanium oxide (TTO55N) | 30 | 6.0 | C | 0.03 | 0.08 |
| 5 | None | なし | Titanium oxide (TTO55N) | 30 | — | D | 0.01 | 0.05 |
| 6 | Titanium oxide (TITANIX) | 180 | Titanium oxide (ST21) | 20 | 9.0 | C | 0.02 | 0.05 |
| 7 | Titanium oxide (SnO2 coverage 25%) | 360 | Titanium oxide (TTO55N) | 30 | 12.0 | B | 0.03 | 0.08 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-252121, filed Nov. 2, 2009 which is hereby incorporated by reference herein in its entirety.

What is claimed is:

1. An electrophotographic photosensitive member comprising a support, and a first intermediate layer, a second intermediate layer and a photosensitive layer, the layers being provided on the support in this order, wherein the second intermediate layer contains a polyolefin resin and metal oxide particles having a volume-average particle diameter of 20 nm or less, the first intermediate layer contains metal oxide particles, and a volume-average particle diameter of the metal oxide particles contained in the first intermediate layer is 10 times to 200 times as large as the volume average particle diameter of the metal oxide particles contained in the second intermediate layer.

2. The electrophotographic photosensitive member according to claim 1, wherein a volume-average particle diameter of the metal oxide particles contained in the second intermediate layer is 10 nm or less.

3. The electrophotographic photosensitive member according to claim 1, wherein the polyolefin resin contained in the second intermediate layer contains (A1), (A2) and (A3) as described below, and the mass ratio of the (A1), (A2) and (A3) satisfies inequalities as described below:

$$0.01 \leqq (A2)/\{(A1)+(A2)+(A3)\} \times 100 \leqq 30$$

$$55/45 \leqq (A1)/(A3) \leqq 99/1$$

(A1): a repeating structural unit represented by the following formula (11)

(11)

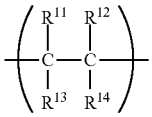

where $R^{11}$ to $R^{14}$ each independently represent a hydrogen atom or an alkyl group;

(A2): a repeating structural unit represented by one of the following formulae (21) and (22)

(21)

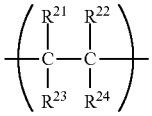

(22)

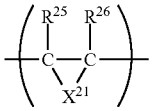

where $R^{21}$ to $R^{24}$ each independently represent a hydrogen atom, an alkyl group, a phenyl group, or a monovalent group represented by —$Y^{21}$COOH where $Y^{21}$ represents a single bond, an alkylene group, or an arylene group; $R^{25}$ and $R^{26}$ each independently represent a hydrogen atom, an alkyl group or a phenyl group; and $X^{21}$ represents a divalent group represented by —$Y^{22}$COOCO$Y^{23}$— where $Y^{22}$ and $Y^{23}$ each independently represent a single bond, an alkylene group or an arylene group, provided that at least one of $R^{21}$ to $R^{24}$ represents a monovalent group represented by —$Y^{21}$COOH; and (A3): a repeating structural unit represented by one of the following formulae (31), (32), (33) and (34)

(31)

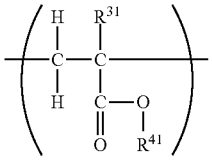

(32)

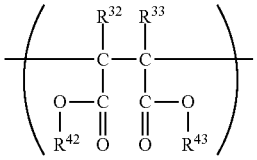

(33)

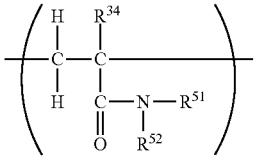

-continued (34)

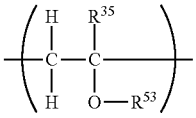

where $R^{31}$ to $R^{35}$ each independently represent a hydrogen atom or a methyl group; $R^{41}$ to $R^{43}$ each independently represent an alkyl group having 1 to 10 carbon atoms; and $R^{51}$ to $R^{53}$ each independently represent a hydrogen atom or an alkyl group having 1 to 10 carbon atoms.

4. The electrophotographic photosensitive member according to claim 3, wherein the mass ratio of the (A1), (A2) and (A3) satisfies an inequality as described below:

$$0.01 \leqq (A2)/\{(A1)+(A2)+(A3)\} \times 100 \leqq 10$$

5. The electrophotographic photosensitive member according to claim 4, wherein the mass ratio of the (A1), (A2) and (A3) satisfies an inequality as described below:

$$0.01 \leqq (A2)/\{(A1)+(A2)+(A3)\} \times 100 \leqq 5,$$

6. The electrophotographic photosensitive member according to claim 3, wherein each of (A1), (A2) and (A3) are repeating structural units represented by the following formulae (111), (221) and (311), or repeating structural units represented by the following formulae (111), (221) and (312):

(111)

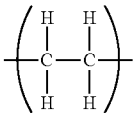

(221)

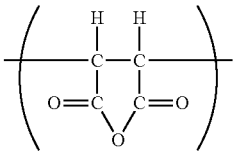

(311)

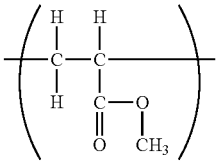

(312)

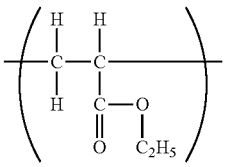

7. The electrophotographic photosensitive member according to claim 1, wherein the photosensitive layer is formed of a charge generation layer containing a charge-generating material and a hole transport layer containing a hole transporting material, which are arranged in this order from the support side.

8. A process cartridge which integrally supports the electrophotographic photosensitive member according to claim 1, and at least one unit selected from the group consisting of a charging unit, a developing unit, a transferring unit and a cleaning unit, and is attachable to and detachable from a main body of an electrophotographic apparatus.

9. An electrophotographic apparatus comprising the electrophotographic photosensitive member according to claim 1, a cleaning unit, an exposing unit, a developing unit and a transferring unit.

10. The electrophotographic photosensitive member according to claim 1, wherein the volume-average particle diameter of the metal oxide particles contained in the first intermediate layer is 20 times to 200 times as large as the volume average particle diameter of the metal oxide particles contained in the second intermediate layer.

* * * * *